United States Patent [19]

Hattori

[11] 4,375,746

[45] Mar. 8, 1983

[54] EXHAUST GAS PURIFYING METHOD OF AN INTERNAL COMBUSTION ENGINE

[75] Inventor: Kyo Hattori, Susono, Japan

[73] Assignee: Toyota Jidosha Kogyo Kabushiki Kaisha, Aichi, Japan

[21] Appl. No.: 173,017

[22] Filed: Jul. 28, 1980

[30] Foreign Application Priority Data

Aug. 6, 1979 [JP] Japan ..... 54-99407

[51] Int. Cl.[3] ..... F01N 3/22

[52] U.S. Cl. ..... 60/274; 60/276; 60/289; 60/290

[58] Field of Search ..... 60/274, 276, 289, 290; 123/440, 489

[56] References Cited

U.S. PATENT DOCUMENTS 4,119,074 10/1978 Masaki ..... 60/276
4,131,089 12/1978 Fujishiro ..... 60/276
4,175,386 11/1979 Katahira ..... 60/276
4,203,394 5/1980 Aono ..... 123/489
4,211,074 7/1980 Hattori ..... 60/276

*Primary Examiner*—Douglas Hart
*Attorney, Agent, or Firm*—Stevens, Davis, Miller & Mosher

[57] ABSTRACT

An air-fuel ratio discrimination signal, having two voltage levels depending upon whether the air-fuel ratio of the engine is rich or lean in comparison with a predetermined air-fuel ratio, is generated in accordance with the sensed signal from a sensor which detects the concentration of a particular component in the exhaust gas. Then, the amount of secondary air supplied into the exhaust system of the engine is gradually increased or decreased in accordance with the level of the air-fuel ratio discrimination signal. Furthermore, the amount of secondary air supplied into the exhaust system is additionally increased or decreased in accordance with the average value of the air-fuel ratio discrimination signal.

7 Claims, 6 Drawing Figures

EXHAUST GAS PURIFYING METHOD OF AN INTERNAL COMBUSTION ENGINE

BACKGROUND OF THE INVENTION

The present invention relates to a method of purifying exhaust gas of an internal combustion engine particularly, the present invention relates to a method of purifying exhaust gas by controlling the amount of secondary air supplied into an exhaust system of the engine so as to stabilize the purification efficiency of a catalytic converter.

In a system for purifying exhaust gas, which system simultaneously reduces the noxious components of HC, CO and NOx contained in the exhaust gas by means of a three-way catalytic converter provided in an exhaust system of an internal combustion engine, it is necessary to control the air-fuel ratio of the exhaust gas which flows into the three-way catalytic converter within a very narrow range (hereinafter referred to as "window range") around a stoichiometric air-fuel ratio. This is because the purification efficiency of the three-way catalytic converter becomes highest in the above-mentioned window range. In the conventional system of purifying exhaust gas by controlling the amount of the secondary air which is supplied into the exhaust system, the air-fuel mixture which is supplied into the combustion chambers of the engine is set to be rich in comparison with the stoichiometric air-fuel ratio. Then, a suitable amount of secondary air is supplied into the exhaust system upstream of the catalytic converter, thereby controlling the exhaust gas air-fuel ratio within the above-mentioned window range. The amount of the supplied secondary air, in this case, is controlled so as to gradually increase when an air-fuel ratio sensor, which is provided in the exhaust system of the engine and detects the concentration of a particular component, such as an oxygen component, contained in the exhaust gas, detects that the exhaust gas air-fuel ratio is rich; it is controlled so as to gradually decreases when the air-fuel ratio sensor detects that the exhaust gas air-fuel ratio is lean.

However, in such a system as mentioned above, if the average level of the air-fuel ratio which is adjusted in an intake system (hereinafter referred to as "base air-fuel ratio") deviates from a standard value due to change in the driving condition of the engine or to deterioration of parts, the average air-fuel ratio of the exhaust gas deviates from the stoichiometric air-fuel ratio, thereby lowering the accuracy of the control of the air-fuel ratio as a whole. As a result, the purification efficiency of the three-way catalytic converter is reduced, thereby causing bad emissions.

SUMMARY OF THE INVENTION

It is, therefore, an object of the present invention to provide an exhaust gas purifying method whereby a stable efficiency for purification of the exhaust gas, even when the base air-fuel ratio varies, can be obtained.

According to the present invention, an exhaust gas purifying method comprises the steps of: generating, in response to a sensed signal from an air-fuel ratio sensor, an air-fuel ratio discrimination signal having two voltage levels depending upon whether the air-fuel ratio of an engine is rich or lean in comparison with a predetermined air-fuel ratio; gradually increasing or decreasing, in response to the level of the air-fuel ratio discrimination signal, the amount of secondary air supplied into an exhaust system of the engine from an air adjusting means, and, additionally increasing or decreasing the amount of secondary air supplied into the exhaust system from the air adjusting means, in accordance with the average value of the air-fuel ratio discrimination signal or with the average value of the sensed signal from said air-fuel ratio sensor.

The above-mentioned and other related objects and features of the present invention will be apparent from the following description of the present invention with reference to the accompanying drawings, as well as from the appended claims.

DETAILED DESCRIPTION OF THE PREFERRED EMBODIMENTS

Figure 1:
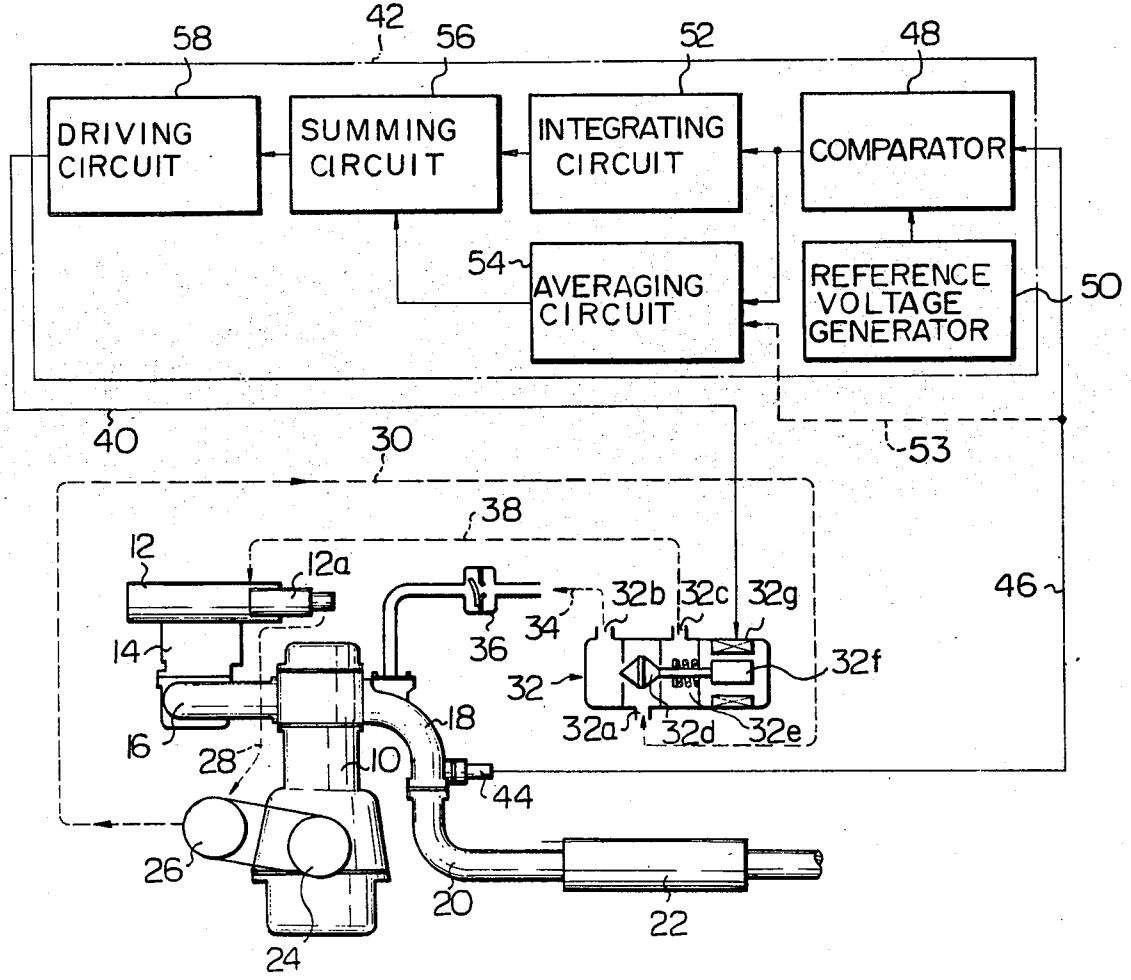
FIG. 1 is a schematic view illustrating an embodiment according to the present invention.

Referring to FIG. 1, which is a schematic illustration of an embodiment in accordance with the present invention, reference numeral 10 denotes an engine body, 12 an air cleaner, 14 a carburetor, 16 an intake manifold, 18 an exhaust manifold, 20 an exhaust pipe and 22 a three-way catalytic converter. An air-fuel mixture having an air-fuel ratio which is rich in comparison with a stoichiometric air-fuel ratio as set in the carburetor 14 is supplied into combustion chambers (not illustrated) of the engine, so as to generate an output for rotating a crank shaft 24. Then, the combusted gas from the combustion chambers is sent, through the exhaust manifold 18 and the exhaust pipe 20, into the three-way catalytic converter 22, and the purified gas is released into the atmosphere.

Reference numeral 26 in FIG. 1 denotes an air pump for supplying secondary air, which is driven by the rotation of the crank shaft 24. This air pump 26 compresses the air which is introduced through an air filter 12*a* of the air cleaner 12 and a pipe 28, and sends the air to the first port 32*a* of an air control valve 32 through a pipe 30. The second port 32*b* of the air control valve 32 is in communication with the exhaust manifold 18 through a pipe 34 and a check valve 36. The third port 32*c* of the air control valve 32 is in communication with the air cleaner 12 through a pipe 38. A valve member 32*d* of the air control valve 32 is movable in its axial direction in accordance with a magnetic force generated between a core 32*f* which is connected to the valve member 32*d* and an electromagnet 32*g*, and against a force of spring 32*e*. A certain amount of secondary air which corresponds to the axial movement of the valve member 32*d* is supplied to the exhaust manifold 18 through the port 32*b* and other secondary air (relief air) is sent to the air cleaner 12 through the port 32*c*. The movement of the valve member 32*d* is in proportion to the electric current which is supplied to an energizing coil of the electromagnet 32g through a line 40 from a control circuitry 42.

An airfuel ratio sensor 44 which detects the concentration of a particular component in the exhaust gas, such as an oxygen component, is provided at a downstream location of a port for the supply of secondary air in the exhaust manifold 18. A sensed signal which is generated by this airfuel ratio sensor 44 is sent to the control circuitry 42 through a line 46.

Reference numeral 48 in the control circuitry 42 denotes a comparator circuit which compares the signal detected by the air-fuel ratio sensor 44 with a reference voltage generated in a reference voltage generator circuit 50, and selectively generates an air-fuel ratio discrimination signal at a high level voltage or a low level voltage depending upon whether the level of the signal which is sent by the air-fuel ratio sensor 44 is higher or lower than the reference voltage, respectively. The air-fuel ratio discrimination signal from the comparator circuit 48 is supplied not only to an integrating arithmetic circuit 52 but also to an averaging arithmetic circuit 54. In another embodiment, the sensed signal from the air-fuel ratio sensor 44 is supplied to the averaging arithmetic circuit 54 through a line 53, instead of the air-fuel ratio discrimination signal. The output from the integrating arithmetic circuit 52 gradually increases or decreases depending upon whether the air-fuel ratio discrimination signal is at a high level or at a low level. On the other hand, the averaging arithmetic circuit 54 develops an output corresponding to an average value of the air-fuel ratio discrimination signals or the sensed signal from the sensor 44. The outputs from the integrating arithmetic circuit 52 and the averaging arithmetic circuit 54 are added to each other in a summing circuit 56, so as to result in an electric current which corresponds to the result of the addition in a driving circuit 58. This electric current is supplied to the electromagnet 32g of the air control valve 32 through the line 40. It is in this manner that the secondary air quantity is controlled.

Figure 2:
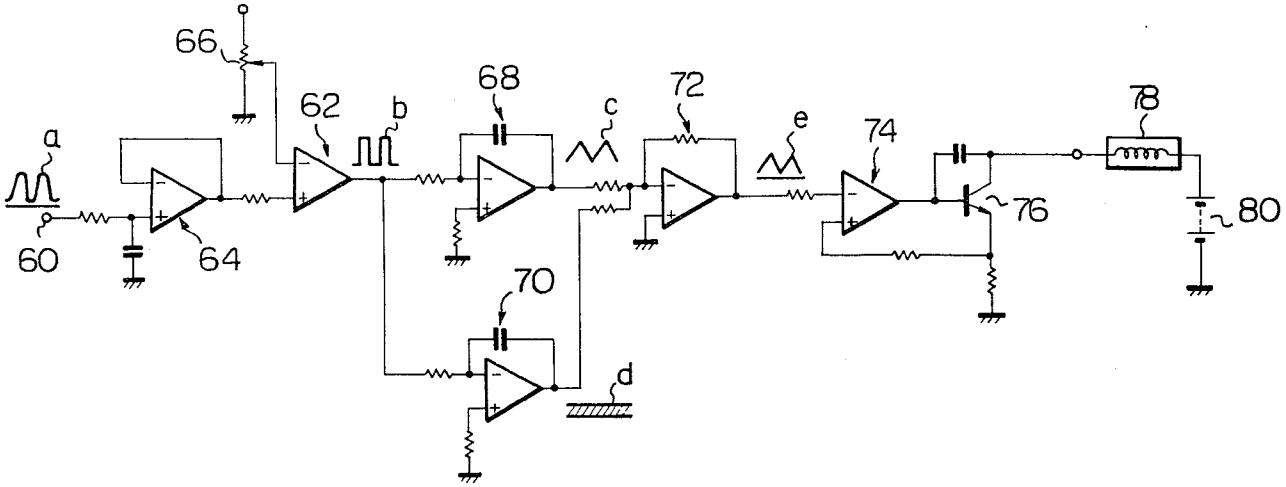
FIG. 2 is a circuit diagram illustrating an example of the control circuit illustrated in FIG. 1.

FIG. 2 illustrates a detailed circuit diagram as one example of the control circuitry 42 which is illustrated in FIG. 1. In this case, the portion including the integrating circuit 52, the averaging circuit 54 and the summing circuit 56 in FIG. 1 is constituted by an analogue circuit. Reference numeral 60 in FIG. 2 denotes a terminal which is connected to an output terminal of the air-fuel ratio sensor 44. A non-inverting input terminal of the comparator circuit 62, which consists of an operational amplifier, is connected to the terminal 60 through a buffer amplifier 64. A variable terminal of a variable resistor 66, which constitutes the reference voltage generator circuit, is connected to the inverting input terminal of the comparator circuit 62. In this case, the fixed terminals of the variable resistor 66 are interposed between a power source of a constant voltage and ground. The output terminal of the comparator circuit 62 is connected to input terminals of integrators 68 and 70, which include operational amplifiers, respectively. Although the time constant for integration of the integrator 68 is set in such a way as to have a comparatively small value, the time constant for integration of the integrator 70 is set in such a way as to have a very large value. As a result, the integrator 68 develops an integrated output which gradually decreases or increases depending upon the output from the integrator 68, which is at a high level or at a low level, but the integrator 70 develops an output which is an average of the output level of the comparator 62. The output terminals of both the integrators 68 and 70 are respectively connected to the input terminal of an adder 72 which comprises an operational amplifier.

The output terminal of the adder 72 is connected to the inverting input terminal of an amplifier 74, the output terminal of which is connected to the base of a transistor 76. In addition, the non-inverting input terminal of the amplifier 74 is connected to the emitter of the transistor 76 by way of a resistor. The collector of the transistor 76 is connected in series to a power source 80 via a coil 78 of the electromagnet 32g of the air control valve 32. The circuit including the amplifier 74 and the transistor 76 forms a current driving circuit which corresponds to the driving circuit 58 in FIG. 1, thereby making it possible to obtain a current output corresponding to the output voltage of the adder 72 as the collector current of the transistor 76.

The operation of the present invention, in particular of the control circuitry shown in FIG. 2, will now be explained.

The air-fuel ratio sensor 44 develops a signal which is at a high level, for example, 0.9 V or so, in a case where the exhaust gas air-fuel ratio is rich in comparison with the stoichiometric air-fuel ratio. On the other hand, the air-fuel ratio sensor 44 develops a signal which is at a low level, for example, 0.1–0.2 V or so, in a case where the exhaust gas air-fuel ratio is lean in comparison with the stoichiometric air-fuel ratio. As illustrated in FIG. 2, the signal a, which is detected by the air-fuel ratio sensor 44, is sent to the comparator 62 through the terminal 60 and the buffer amplifier 64. In the comparator 62, the signal a is compared with a reference voltage of 0.5–0.85 V or so which is sent from the variable resistor 66. The output of the comparator 62, that is, the air-fuel ratio discrimination signal b, has a rectangular wave form wherein the signal b is maintained in a high level state if the exhaust gas is in a rich condition, but is maintained in a low level state if the exhaust gas is in a lean condition. Then, the signal b is integrated through the integrator 68 in such a way as to result in a decreasing saw-tooth signal c if it is in a high level state, but the signal b is integrated through the integrator 68 in such a way as to result in an increasing saw-tooth signal c if it is in low level state. On the other hand, the air-fuel ratio discrimination signal b is integrated through the integrator 70 with a very large time constant for integration in such a way as to result in a signal d which is at a level corresponding to the average value of inverted signals of the air-fuel ratio discrimination signals b. The output signals c and d of these integrators 68 and 70 are added in the adder 72, and at the same time, the level thereof is inverted in such a way as to result in a signal e. This signal e is converted into a current signal corresponding to the level in the driving circuit comprising the amplifier 74 and the transistor 76. This current signal is sent to the electromagnet 32g of the air control valve 32. As a result, the valve member 32d of the air control valve 32 moves by an amount corresponding to the current signal. It is in this manner that the quantity of the secondary air which is supplied to the exhaust manifold 18 of the engine is caused to vary in correspondence with the movement of the valve member 32d of the air control valve 32.

The feedback control for the amount of the secondary air is carried out as mentioned above, whereby the exhaust gas air-fuel ratio is controlled so as to be within a desired window range. Even if the base air-fuel ratio varies, stable control within the desired range can be ensured. The reasons therefor will now be explained with reference to FIGS. 3*a* and 3*b*.

Figure 3A:
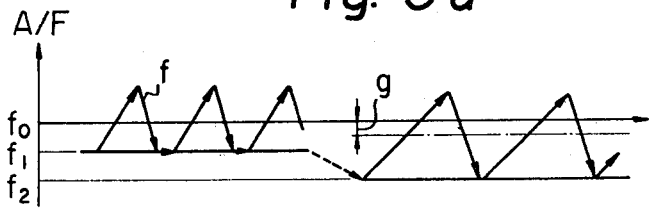
FIGS. 3*a* and 3*b* are explanatory views for explaining the function and effect of the embodiment illustrated in FIG. 1.
Figure 3B:
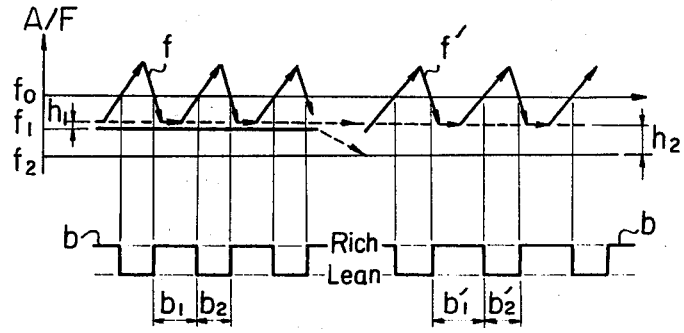

The change of the exhaust gas air-fuel ratio after the secondary air has been supplied, in other words, the change of the air-fuel ratio in the exhaust gas which flows into the catalytic converter will be explained with reference to FIGS. 3*a* and 3*b* with respect to a particular time at which the base air-fuel ratio has varied. FIG. 3*a* illustrates the change in accordance with the prior art, while FIG. 3*b* illustrates the change in accordance with the present invention. When the base air-fuel ratio varies in a direction to result in a richer air-fuel condition as indicated by $f_2$ in FIG. 3*a*, the average value (central value) of the exhaust gas air-fuel ratio f varies by an amount g in the direction to result in a richer air-fuel condition in accordance with the prior art, even if the amount of the secondary air is controlled so as to be increased or decreased in response to the signal which is detected by the air-fuel ratio sensor 44 when the base air-fuel ratio is $f_1$ and the exhaust gas air-fuel ratio f is controlled within a desired range near the stoichiometric air-fuel ratio $f_0$. As a consequence, the purification efficiency of the three-way catalytic converter goes outstandingly bad. To the contrary, the time that the air-fuel ratio discrimination signal b is maintained in a high level state becomes long as illustrated in FIG. 3*b*, in accordance with the present invention, when the base air-fuel ratio varies from $f_1$ to $f_2$. In other words, when the base air-fuel ratio varies from $f_1$ to $f_2$, the duty ratio of the air-fuel ratio discrimination signal b varies from $b_1/(b_1+b_2)$ to $b_1'/(b_1'+b_2')$, so as to increase the average value of the air-fuel ratio discrimination signal. Accordingly, the quantity of the secondary air is always increased by an amount corresponding to the increase of the average value of the exhaust gas air-fuel ratio. That is, FIG. 3*b* illustrates that the bias for secondary air corresponding to $h_1$ when the base air-fuel ratio is $f_1$ varies to a bias corresponding to $h_2$ when the base air-fuel ratio becomes $f_2$. As the result, the exhaust gas air-fuel ratio f' after the supply of the secondary air is controlled varies in such a way as to be increased or decreased by an equal amount in comparison with the stoichiometric air-fuel ratio, thereby effectively correcting the deviation g of the average value of the exhaust gas air-fuel ratio after the supply of secondary air is controlled by the prior art as illustrated in FIG. 3*a*. As a consequence, it becomes possible that the purification efficiency of the catalytic converter is always kept constant at its best value.

It should be understood that some suitable combination of a capacitor and a resistor may be used instead of the integrator 70, and that a charge-and-discharge circuit or a smoothing circuit may be used.

Figure 4:
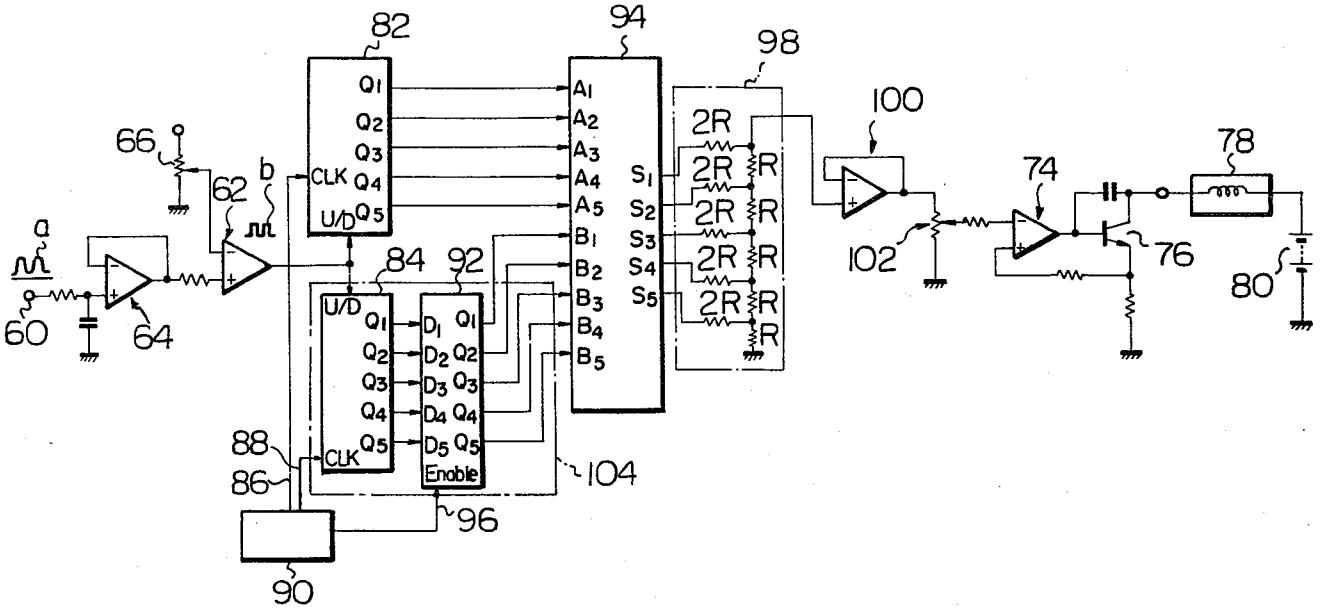
FIG. 4 is a circuit diagram illustrating another example of the control circuit.

In FIG. 4, which is a detailed circuit diagram of another example of the control circuitry 42, the part including the integrating arithmetic circuit 52, the averaging arithmetic circuit 54 and the summing circuit 56 in FIG. 1 is constituted as digital circuits. The same reference numerals in FIG. 4 as used in FIG. 2 indicate the same or corresponding elements. Reference numerals 82 and 84 in FIG. 4 denote up-down counters, of which the up-down switching control terminals (U/D terminals) are connected to the output terminal of the comparator 62 and of which the clock signal input terminals (CLK terminals) are connected to a clock pulse generator circuit 90 through lines 86 and 88, respectively. The output terminals $Q_1$ to $Q_5$ of the up-down counter 84 indicating five bits are respectively connected to the input terminals $D_1$ to $D_5$ of a latch circuit 92. The output terminals $Q_1$ to $Q_5$ of the latch circuit 92 are respectively connected to the input terminals $B_1$ to $B_5$ of an adder 94. The output terminals $Q_1$ to $Q_5$ of the up-down counter 82 are respectively connected to the input terminals $A_1$ to $A_5$ other than the input terminals $B_1$ to $B_5$ of the adder 94. The Enable terminal of the latch circuit 92 is connected to the clock signal generator 90 through a line 96. The clock signal generator 90 generates three kinds of pulse signals with periods which are different from one another in such a way as to be, for example, 0.005 sec., 0.1 sec. and 100 sec. In this case, for example, the pulse signal of the period of 0.005 sec. is supplied to the CLK terminal of the up-down counter 82 through the line 86, the pulse signal of the period of 0.01 sec. is supplied to the CLK terminal of the up-down counter 84 through the line 88 and the pulse signal of the period of 100 sec. is supplied to the Enable terminal of the latch circuit 92 through the line 96. The output terminals $S_1$ to $S_5$ of the adder 94 are connected to an R–2R ladder network circuit 98 in turn from the lower crosspieces thereof, respectively. The R–2R ladder network circuit 98 is a well known A/D converter circuit which converts a binary output into an analogue voltage. The output terminal of this circuit 98 is connected to one fixed terminal of a variable resistor 102 through a buffer amplifier 100. The other fixed terminal of the variable resistor 102 is earthed. The variable terminal of the variable resistor 102 is connected to the input terminal of the amplifier 74.

The operation of the control circuit which is illustrated in FIG. 4 will now be explained. If the level of the air-fuel ratio discrimination signal b from the comparator 62 becomes high, each of the up-down counters 82 and 84 counts up the clock pulse signals which are generated from the clock signal generator 90, thereby increasing the counted value. On the contary, if the level of the air-fuel raito discrimination signal b becomes low, each of the up-down counters 82 and 84 counts down. Thus, the counted value of the up-down counter 82 gradually increases if the exhaust gas air-fuel ratio is in a rich state and, thus, the level of the air-fuel ratio discrimination signal b is high. To the contrary, if the exhaust gas air-fuel ratio is in a lean state and, thus, the level of the air-fuel ratio discrimination signal b is low, the counter value of the up-down counter 82 gradually decreases. On the other hand, the counted value of the up-down counter 84 varies more slowly than the above-mentioned up-down counter 82 and is repeatedly increased and decreased so as to result in a value corresponding to the average value of the air-fuel ratio discrimination signals b. This counted value is taken every 100 sec. and kept by the latch circuit 92. The adder 94 adds the output value of the up-down counter 82 and the value which is kept in the latch circuit 92. The binary signal which is the output of the adder 94 is converted in the ladder network 98 into an analogue voltage and is subjected to an impedance transformation in the buffer amplifier 100. After that, a suitable voltage, which is obtained as a result of division of the voltage of the signal by means of the variable resistor 102, is applied to the amplifier 74. The operation after this is the same as that in the circuit of FIG. 2. In addition, the function and effect which is brought about by the control circuit of FIG. 4 is also the same as that in FIG. 2.

Figure 5:
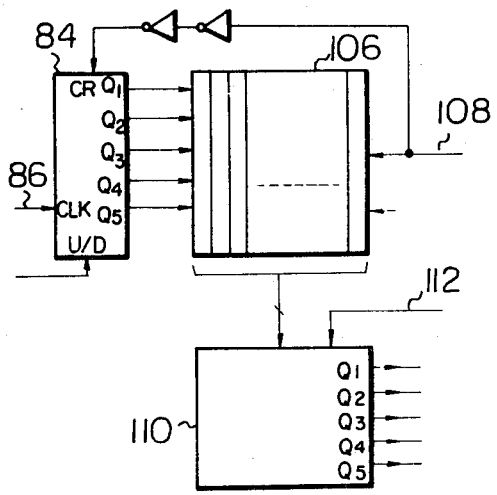
FIG. 5 is a circuit diagram illustrating a modification in part of the control circuit illustrated in FIG. 4.

FIG. 5 illustrates another example of the averaging arithmetic circuit 104 which is illustrated in FIG. 4. In FIG. 5, the reference numeral 84 denotes an up-down counter which is the same as that illustrated in FIG. 4 and reference numeral 106 denotes a memory which is provided with a plurality of, for example, one hundred, unit memory elements of a bit number which is equal to the output bit number of the up-down counter 84. The memory 106 receives the counted value of the up-down counter 84 upon receipt of every clock pulse signal having the period, for example, of 0.5 sec., which clock pulse signal is supplied thereto by way of the line 108 so as to shift the counted value, which has been previously received, to the next memory in due order of succession. Reference numeral 110 denotes an adder and subtracter, which adds or subtracts the values as stored in the elements in the memory 106 upon receipt of every clock signal of a predetermined period, which clock signal is supplied thereto through the line 112. The result of the addition or subtraction is developed as the output signal of the adder and substractor 110, which output signal is then supplied to the adder 94. The up-down counter 84 is reset by a pulse signal formed by delaying a clock pulse signal which is supplied thereto through the line 108, just after its counted value is fed into the memory 106 in response to the above-mentioned clock pulse signal supplied thereto via the line 108. In accordance with the circuit of FIG. 5, it becomes possible to obtain a correct average value of the air-fuel ratio discrimination signals with a good response.

Figure 6:
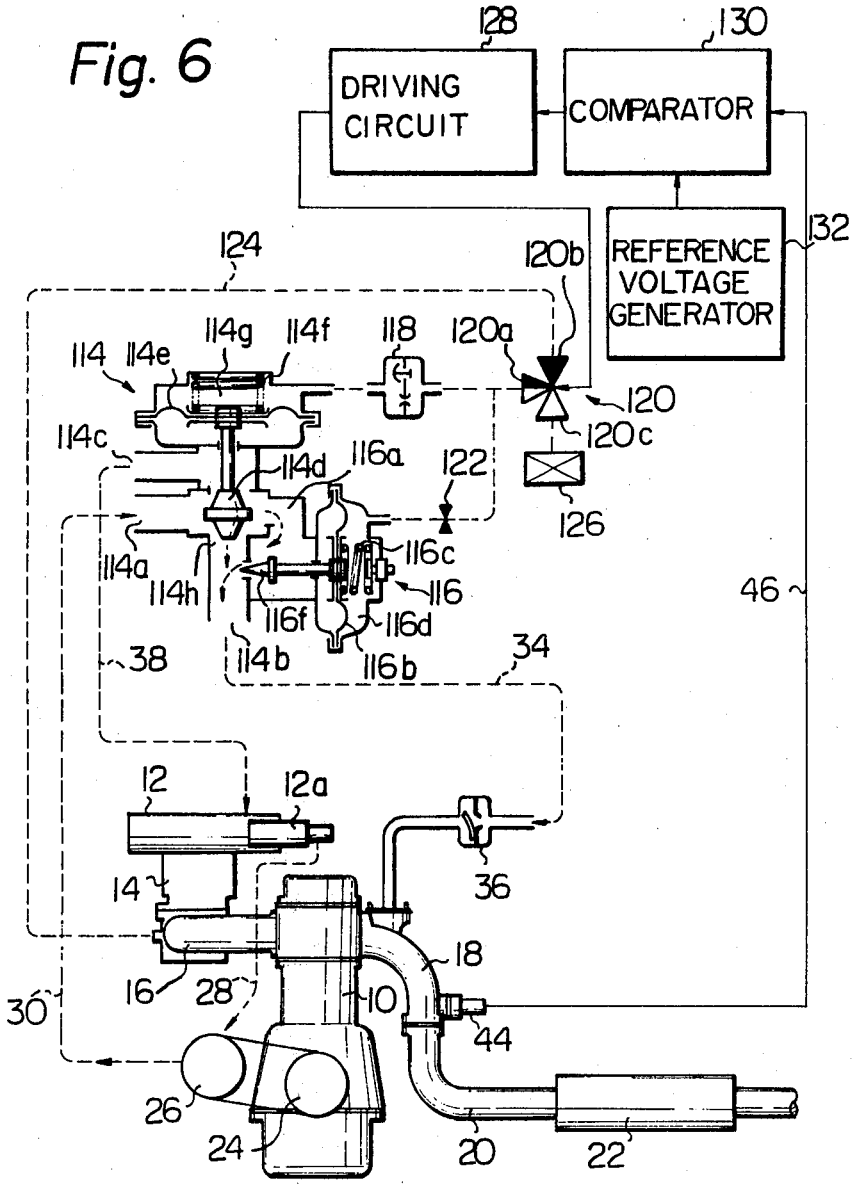
FIG. 6 is a schematic view of another embodiment according to the present invention.

FIG. 6 is a schematic view of still another embodiment in accordance with the present invention. Although the operation to correct the amount of the secondary air supplied into the engine due to the change of the base air-fuel ratio is electrically controlled in the embodiment of FIG. 1, in this embodiment, it is controlled by means of a fluid utilizing a negative pressure (vacuum) and an atmospheric pressure. For the purpose of brevity, the explanation below of the embodiment of FIG. 6 will be directed only to the parts which are different from those in FIG. 1. The same reference numerals as employed in FIG. 1 indicate the same or a corresponding element in FIG. 6.

Reference numeral 114 in FIG. 6 denotes an air control valve of a diaphragm type which is driven by the fluid, such as vacuum. The first port 114*a* of the air control valve 114 is in communication with the air pump 26 through the pipe 30, the second port 114*b* is in communication with the exhaust manifold 18 through the pipe 34 and the check valve 36, and the third port 114*c* is in communication with the air cleaner 12 through the pipe 38. A valve member 114*d* of this air control valve 114 moves in its axial direction as a diaphragm 114*e*, which is connected to the valve member 114*d*, is moved by a pushing force of a spring 114*f* and a pulling force due to the negative pressure in a diaphragm chamber 114*g*. Secondary air of a quantity which corresponds to the movement of the valve member 114*d* passes through a passage 114*h* and is supplied to the exhaust manifold 18 through the port 114*b*.

Reference numeral 116 in FIG. 6 denotes a bias air control valve which controls the quantity of secondary air bypassing the passage 114*h* of the air control valve 114. In other words, some of the secondary air which is supplied from the air pump 26 passes not through the passage 114*h*, but through the passage 116*a* of the air control valve 116 into the exhaust manifold 18. The diaphragm 116*b* is moved by the pressing force of the spring 116*c* and the pulling force due to the negative pressure in the diaphragm chamber 116*d*, thereby moving the valve member 116*f*, which is connected to the diaphragm 116*b*, in the axial direction thereof so as to control the quantity of the secondary air bypassing the passage 114*h* of the air control valve 114 as mentioned above.

On the other hand, the diaphragm chamber 114*g* of the air control valve 114 is in communication with the first port 120*a* of a three-way electromagnetic valve 120 through a one-way delay valve 118. In addition, this port 120*a* is in communication with the diaphragm chamber 116*d* of the bias air control valve 116 through an orifice 122 having a relatively small cross-sectional area. The second port 120*b* of the three-way electromagnetic valve 120 is in communication with the intake manifold 16 through a pipe 124, and the third port 120*c* thereof is opened into the atmosphere through an air filter 126. If the three-way electromagnetic valve 120 is supplied with a driving signal which energizes its coil (which is not illustrated) from the driving circuit 128, the port 120*a* becomes in communication with the port 120*b*. If the three-way electromagnetic valve 120 is supplied with a driving signal which deenergizes its coil, the port 120*a* is switched in such a way as to become in communication with the port 120*c*. The driving circuit 128 develops a driving signal which energizes the electromagnetic valve 120 if the air-fuel ratio discrimination signal, which is developed from the comparator circuit 130, is maintained in a high level state, while the driving circuit 128 develops a driving signal which deenergizes the electromagnetic valve 120 if the air-fuel ratio discrimination signal, which is developed from the comparator circuit 130, is maintained in a low level state.

The constitution, function and effect of the comparator circuit 130 and the reference voltage generator circuit 132 are entirely the same as those of the comparator 48 and the reference voltage generator circuit 50 which are illustrated in the embodiment of FIG. 1.

The operation in accordance with this embodiment will now be explained. If the exhaust gas air-fuel ratio becomes rich in comparison with the stoichiometric air-fuel ratio and the level of the air-fuel ratio discrimination signal, which is developed from the comparator circuit 130, becomes high, the electromagnetic valve 120 is energized and negative pressure is gradually introduced into the diaphragm chamber 114*g* of the air control valve 114 by means of the one-way delay valve 118. As the result, the valve member 114*d* gradually moves upwards, so as to gradually increase the quantity of the secondary air which is supplied into the exhaust manifold 18. On the contrary, if the exhaust gas air-fuel ratio becomes lean, the electromagnetic valve 120 is deenergized and the atmospheric pressure is relatively rapidly introduced into the diaphragm chamber 114*g* of the air control valve 114. As a result, the valve member 114*d* moves downwards so as to relatively rapidly decrease the quantity of secondary air which is supplied into the exhaust manifold 18. On the other hand, an average pressure of the atmospheric pressure and a negative pressure which appears at the port 120*a* of the electromagnetic valve 120 is taken out by the orifice 122, so as to be introduced into the diaphragm chamber 116*d* of the bias air control valve 116. As a consequence, if the base air-fuel ratio varies, for example, in such a way as to result in a lean air-fuel mixture, the pressure in the diaphragm chamber 116*d* by way of the orifice 122 varies so as to increase the negative pressure, thereby moving the valve member 116f by an amount which corresponds to the change of pressure, and thus, increasing the quantity of bypass air due to the increase of time that the electromagnetic valve 120 is in communication with the negative pressure. As a result, the quantity of secondary air is corrected in the same way as in the embodiment of FIG. 1.

When the quantity of secondary air which is supplied for the engine is required to be actually controlled, it is also possible for the control in accordance with the present invention as mentioned above to be combined with another control which increases the quantity of the secondary air by an amount which corresponds to the rotational speed of the engine, the pressure in the intake air passage and the like, which are respectively detected.

The present invention, described in detail hereinabove, makes it possible to effectively compensate for the change of the base air-fuel ratio because the quantity of the secondary air is increased or decreased in correspondence with the average value of the air-fuel ratio discrimination signals. In other words, the present invention makes it possible always to maintain the air-fuel ratio of the exhaust gas which flows into the catalytic converter within a desired range. As a consequence, it becomes possible to obtain stable efficiency in purifying the exhaust gas.

As many widely different embodiments of the present invention may be constructed without departing from the spirit and scope of the present invention, it should be understood that the present invention is not limited to the specific embodiments described in this specification, except as defined in the appended claims.

I claim:

1. Method of purifying exhaust gas of an internal combustion engine having an air adjusting means for controlling the amount of secondary air supplied into an exhaust system of the engine, a sensor for detecting concentration of a particular component contained in the exhaust gas after having been mixed with said supplied secondary air, and a catalytic converter for reducing noxious components contained in the exhaust gas after having been mixed with said supplied secondary air, said method comprising the steps of:

generating, in response to a sensed signal from said sensor, an air-fuel ratio discrimination signal having two voltage levels depending upon whether the air-fuel ratio of said engine is rich or lean in comparison with a predetermined air-fuel ratio;

gradually increasing or decreasing, in response to the level of said air-fuel ratio discrimination signal, the amount of secondary air supplied into the exhaust system from said air adjusting means; and, additionally supplying the secondary air to the exhaust system from said air adjusting means, in an amount which changes depending upon the change of the average value of said air-fuel ratio discrimination signal, so as to bias the supplied secondary air amount.

2. Method as claimed in claim 1, wherein said gradually increasing or decreasing step comprises the steps of:

electrically integrating said air-fuel ratio discrimination signal with respect to time and deriving an electrical integration signal; and, electrically driving said air adjusting means so as to control the amount of secondary air supplied into the exhaust system in accordance with said integration signal.

3. Method as claimed in claim 2, wherein said additionally supplying step comprises the steps of:

electrically averaging said air-fuel ratio discrimination signal and deriving an electrical average signal; and, increasing or decreasing the value of said integration signal in accordance with the change of said average signal.

4. Method as claimed in claim 3, wherein said averaging step comprises a step of deriving an analog voltage signal having an average level of said air-fuel ratio discrimination signal.

5. Method as claimed in claim 3, wherein said averaging step comprises a step of deriving an electrical binary signal having a value corresponding to the average level of said air-fuel ratio discrimination signal.

6. Method as claimed in claim 1, wherein said gradually increasing and decreasing step comprises the steps of:

converting said electrical air-fuel ratio discrimination signal to a pneumatic pressure signal having the corresponding levels;

integrating said pneumatic pressure signal with respect to time and deriving an integrated pressure signal; and, driving said air adjusting means so as to control the amount of secondary air supplied into the exhaust system in accordance with said integrated pressure signal.

7. Method as claimed in claim 6, wherein said additionally supplying step comprises the step of:

averaging the level of said pneumatic pressure signal and deriving an average pressure signal; and, increasing or decreasing the amount of secondary air supplied into the exhaust system from said air adjusting means, in accordance with the change of said average pressure signal.

* * * * *